United States Patent [19]

Walsh

[11] 3,955,617

[45] May 11, 1976

[54] SWEPT SURFACE HEAT EXCHANGER WITH DUAL HEAT EXCHANGE MEDIA

[75] Inventor: John C. Walsh, Winchester, Mass.

[73] Assignee: The De Laval Separator Company, Poughkeepsie, N.Y.

[22] Filed: Dec. 9, 1974

[21] Appl. No.: 531,060

[52] U.S. Cl. ..... 165/94; 285/187; 259/DIG. 18

[51] Int. Cl.[2] ..... F28F 5/00

[58] Field of Search ..... 259/9, 10, 191, DIG. 18; 165/94, 11; 285/133 R, 133 A, 134, DIG. 5, 41, 47, 187

[56] References Cited

UNITED STATES PATENTS

| | | | |
|---|---|---|---|
| 1,954,454 | 4/1934 | McFarland | 285/133 R |
| 2,517,921 | 8/1950 | Phares | 165/11 |
| 3,085,961 | 4/1963 | Charlesworth | 165/11 |
| 3,207,533 | 9/1965 | Gundy et al. | 285/187 |
| 3,405,760 | 10/1968 | Smith | 165/94 |
| 3,633,664 | 1/1972 | Walsh | 165/94 |
| 3,724,267 | 4/1973 | Zuschak | 165/11 |
| 3,730,486 | 5/1973 | Hayashi et al. | 165/94 |

*Primary Examiner*—Charles J. Myhre
*Assistant Examiner*—Theophil W. Streule, Jr.
*Attorney, Agent, or Firm*—Cyrus S. Hapgood

[57] ABSTRACT

A product is continuously processed by passing it upwardly through a vertical heat exchange cylinder while continuously scraping the inner surface of the cylinder free of any product which may adhere thereto. This cylinder is surrounded by upper and lower outer cylinders to form upper and lower annular spaces through which respective heat exchange media are circulated, whereby the product can first be heated and then promptly cooled while passing through the heat exchange cylinder. To allow for different rates of expansion and contraction of the cylinders, a double expansion joint is provided between the two outer cylinders; and a temperature sensing device protrudes through this joint and into the heat exchange cylinder to measure the temperature of the product as it passes from the heating section to the cooling section of the heat exchange cylinder.

6 Claims, 2 Drawing Figures

SWEPT SURFACE HEAT EXCHANGER WITH DUAL HEAT EXCHANGE MEDIA

Figure 1:
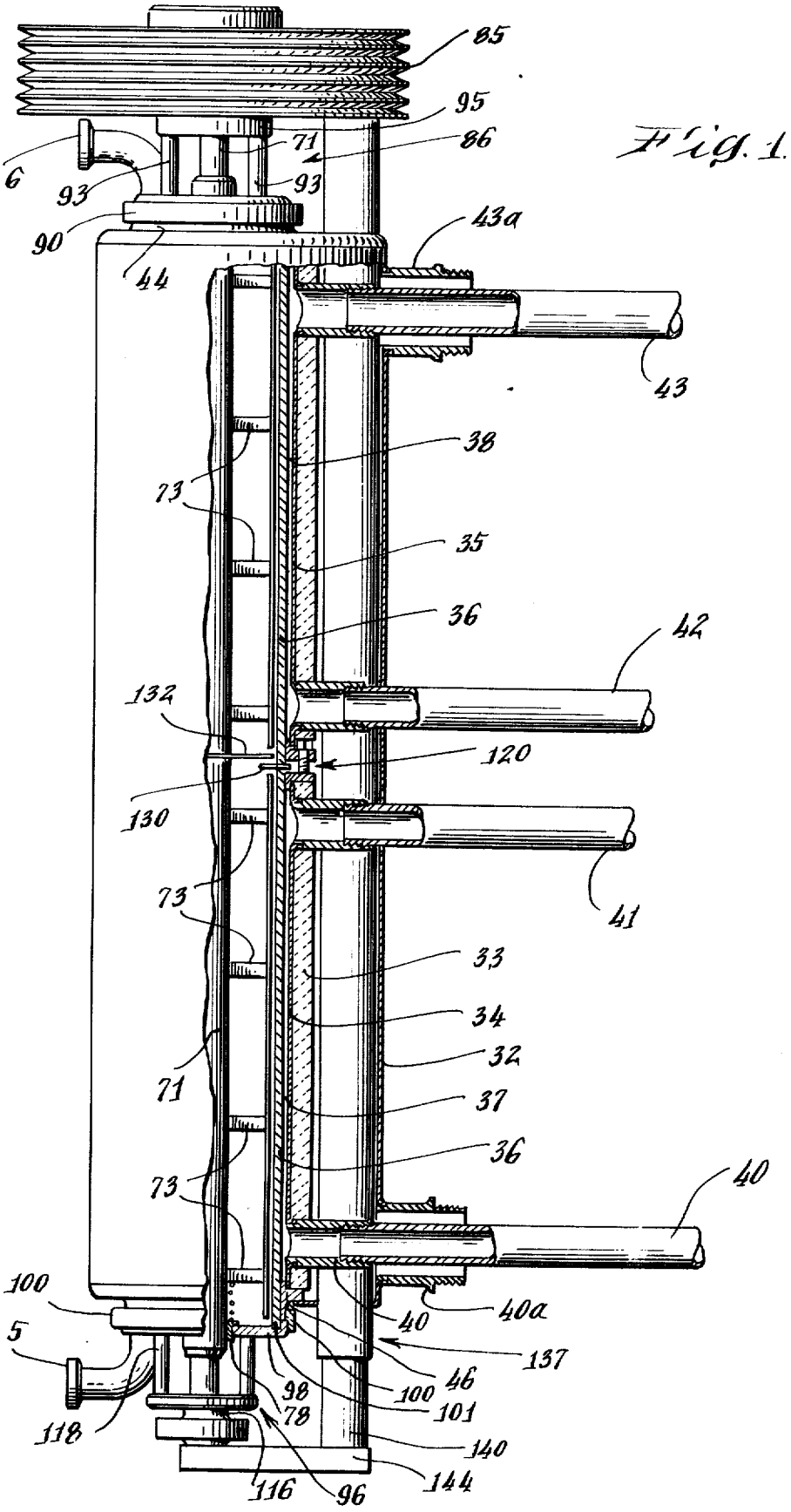

This invention relates to heat exchangers of the type having a vertically oriented heat exchange surface of cylindrical shape which is continuously swept to scrape it free of any product adering thereto. More particularly, the invention relates to a heat exchanger of this type having dual heat exchange media acting on the heat exchange surface.

Swept surface heat exchangers basically are made up of a cylinder with a finished inner surface, a shaft mounted approximately on the cylinder axis, and pins or other means carried by the shaft for mounting scraping blades to continuously scrape layers of heated or cooled liquid from the cylinder wall, the heating or cooling being effected usually by a hot or cold medium in an annulus jacket surrounding the heat exchange cylinder. Such a swept surface heat exchanger is disclosed in U.S. Pat. No. 3,633,664 granted Jan. 11, 1972.

Heat exchangers of this type have conventionally been adapted for only a single heat exchange medium, that is, either a heating medium or a cooling medium. The exchanger must be equipped with heating or cooling jackets and must be of a definite area to accommodate average uses. Also, the mountings for the exchanger are made to take certain fixed sizes of the exchangers to facilitate manufacturing and reduce inventory stocking. The heat exchange units may be made to order to provide certain heat exchange areas for a specific requirement, but generally the heat exchange units are of fixed area and are finished in standard areas or multiples of standard areas.

When a complete heat exchange system is prepared for a given product, it is often the case that a heating section requirement is of substantially less area than a cooling requirement for the same product stream for a given size of machine. It is the general rule that the heating cylinder may run at reduced capacity because the cooling section requires units of a certain size and it is not economical to mount a heating section of a smaller size in framing designed for long cylinders.

It would therefore be desirable to provide both heating and cooling areas in the same heat exchange cylinder. This would effect great economies because the major part of the cost of any swept surface heat exchanger is in its end structures where shaft seals, gaskets, shaft bearings, drive mechanism and means for securing the end heads against internal pressure are located. Regardless of the cylinder length, the end structures are substantially the same, so that it would be a significant advantage to provide a longer cylinder than is needed for the heating requirement and use some of the cylinder area for cooling.

According to the invention, the above-noted advantages are obtained by surrounding the heat exchange cylinder with upper and lower outer cylinders to form upper and lower annular spaces through which respective heat exchange media are circulated, whereby the product is subjected to an initial temperature and then promptly to a substantially different temperature while passing through the heat exchange cylinder. Also, to allow for different rates of expansion and contraction of the cylinders, a double expansion joint is provided between the two outer cylinders, and a single expansion joint is preferably provided at the upper end of the upper outer cylinder. In the preferred construction, a temperature sensing device protrudes through the double expansion joint and into the heat exchange cylinder to measure the temperature of the product as it passes from one section to the other of the heat exchange cylinder.

With this construction, the product can be heated and then cooled without the necessity of providing a separate cooling cylinder. Often there is need for heating a product to high temperatures and immediately cooling the same product. If direct expansion refrigeration is used, as by applying ammonia or freon to the cooling jacket, there are limits in temperature beyond which it is not practical to go, for the reason that good practice in liquid refrigerant uses limits the temperatures they may be subject to by accident. The new construction allows a heater section with a water or other cooling section adjoining to allow the product temperature to be brought down with a cooling medium where subjection to high temperature carries no risk.

Figure 2:
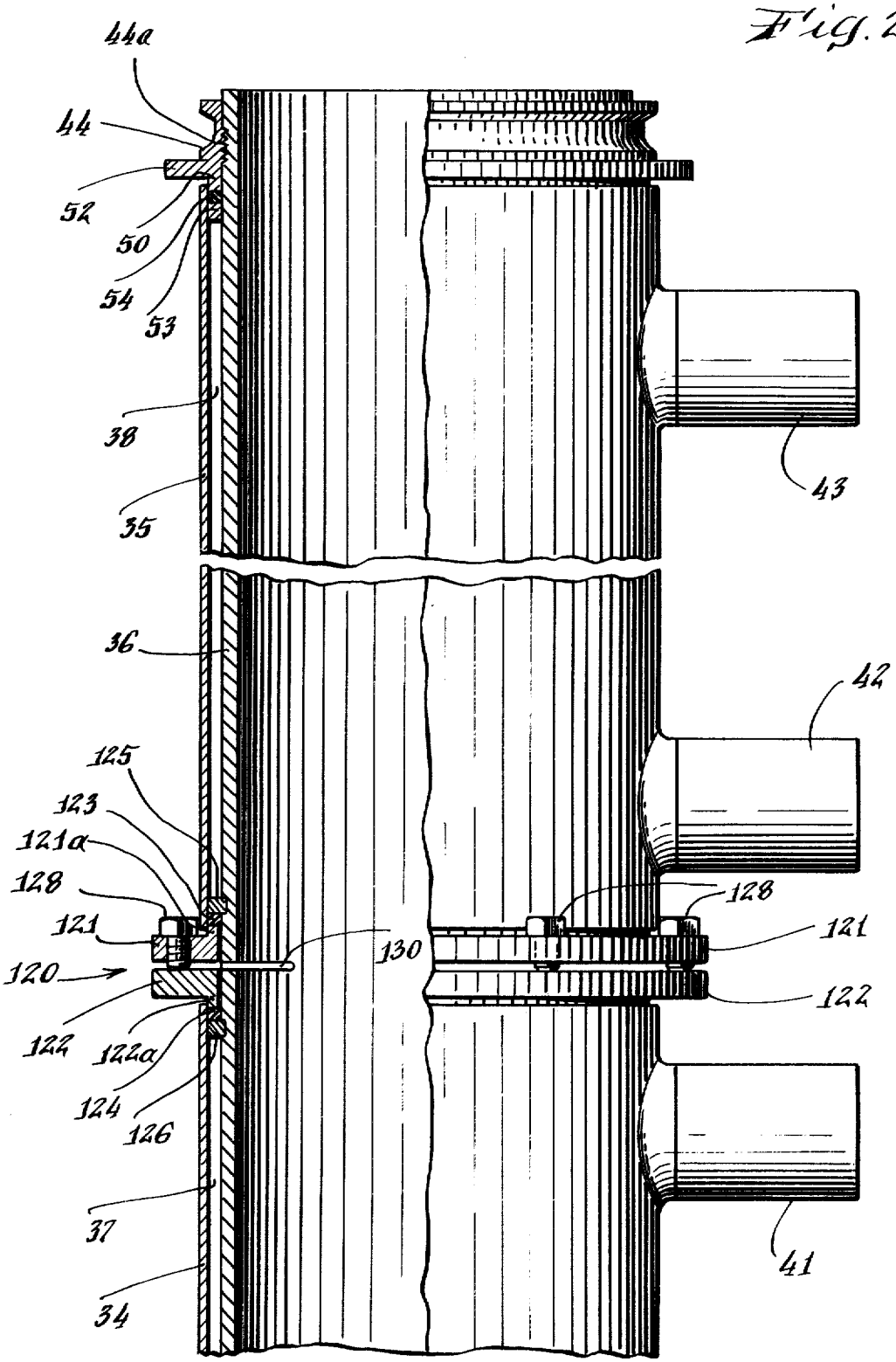

For a better understanding of the invention, reference may be had to the following description in conjunction with the accompanying drawings, in which FIG. 1 is an elevational view, partly in vertical section, of a heat exchanger embodying a preferred form of the invention, and FIG. 2 is an enlarged view, partly in elevation and partly in vertical section, of the upper portion of the inner and outer cylinders shown in FIG. 1.

Referring to FIG. 1, the heat exchanger comprises an outer jacket 32 serving as an enclosure for the operative components and which may be a stainless steel cylinder. Mounted within the lower and upper portions of jacket 32 are outer coaxial cylinders 34 and 35, respectively, which are surrounded by insulation 33. An inner cylinder 36 is positioned concentrically with the vertically aligned outer cylinders 34–35 and has a height somewhat greater than the combined heights of the outer cylinders. Thus, the inner cylinder 36 forms annular spaces 37 and 38 with the surrounding lower and upper cylinders 34 and 35, respectively.

A first heat exchange medium is introduced into the lower annular space 37 through a conduit 40 and is discharged from space 37 through a conduit 41. Similarly, a second heat exchange medium is introduced into the upper annular space 38 through a conduit 42 and is discharged from space 38 through a conduit 43. Conduits 40 and 43 extend through fittings **40*a* and 43*a*, respectively, which are secured to the outer jacket 32** and are connected to a suitable supporting structure (not shown).

The upper and lower ends of jacket 32 are welded or otherwise affixed to upper and lower end hubs 44 and 46, respectively. The lower hub 46 is welded to the lower ends of inner cylinder 36 and outer cylinder 34. As shown in FIG. 2, the upper hub 44 has an annular lower portion 50 and an outwardly extending flange 52 located directly above the lower portion 50. The upper portion of jacket 32 has a fitting (not shown) which seats on the upper surface of flange 52. Hub 44 has internal threads 44a mating with threads on the upper portion of inner cylinder 36. A ring 53 is seated on an external shoulder of inner cylinder 36 and supports a gasket 54 extending around this cylinder. The upper end portion of outer cylinder 35 has a close sliding fit around the lower portion 50 of hub 44 and is spaced below its flange 52.

When hub 44 is screwed down on inner cylinder 36, it compresses gasket 54 against ring 53 so that the gasket seals against the inner surface of outer cylinder 35. Thus, cylinder 35 forms with the parts 44 and 54 an expansion joint seal which permits cylinder 35 to expand upwardly while maintaining a seal at the upper end of the annular space 38.

Rotatably mounted within the inner cylinder 36 is a rotor assembly indicated generally by the reference numeral 70. The assembly comprises basically a central rotor 71 to which is affixed a plurality of radially extending blade pins 73. Each row of the radially extending pins 73 supports a wiper blade 72 which engages the inner surface of the cylinder 36. As the assembly 70 revolves, the blades 72 continuously scrape the inner surface of cylinder 36 free of any product adhering thereto.

The lower portion of shaft 71 is surrounded by a bushing 78 mounted in an end plate 98 forming part of a lower head assembly 96. End plate 98 is joined to the lower hub 46 and held assembled thereto by a releasable clamp 100. A seal 101 is positioned between the lower end of inner cylinder 36 and the upper surface of end plate 98. A plurality of spacer pins 118 are welded to end plate 98 and are affixed at their lower ends to a retainer 116 which contains bearings (not shown) for the lower end of shaft 71.

An elevator 137 has a pison rod 140 secured at its lower end to a lift beam 144 which is affixed to the lower head assembly 96, details of the elevator 137 and assembly 96 being disclosed in said U.S. Pat. No. 3,633,664. As there disclosed, the rotor assembly 70 can be removed for cleaning by releasing clamp 100 and operating elevator 137 to lower the assemblies 70 and 96 from within the inner cylinder 36.

An upper head assembly 86 has an end plate 88 which is joined to the upper end hub 44 and held assembled thereto by a clamp 90. A plurality of spacer pins 93 are welded to the top of end plate 88 and rigidly affixed at their upper ends to a bearing hub 95 which receives the upper end portion of rotor shaft 71. As shown, the shaft 71 is driven through a sheave 85 connected to a suitable power source (not shown). Other details of the upper head assembly 86 may be as disclosed in said U.S. Pat. No. 3,633,664.

Between the two outer cylinders 34 and 35 is a double expansion joint 120 comprising a pair of metal rings 121 and 122, as shown in detail in FIG. 2. These rings surround the inner cylinder 36 with a slight clearance and protrude outwardly from between the opposing spaced ends of outer cylinders 34 and 35. The upper ring 121 has an annular projection **121*a* extending slightly into the space between inner cylinder 36 and the upper outer cylinder 35, and the lower ring 122 has an annular projection 122*a* extending slightly into the space between inner cylinder 36 and the lower outer cylinder 34**.

Gaskets 123 and 124 closely surround inner cylinder 36 within the outer cylinders 35 and 34, respectively. The upper gasket 123 is compressed between the upper ring projection 121a and an overlying ring 125 seated in an annular groove in the inner cylinder 36. Similarly, the lower gasket 124 is compressed between the lower ring projection **122*a* and a ring 126** seated in an annular groove in the inner cylinder.

Rings 121 and 122 are held in their gasket-compressing positions by means of bolts 128 spaced around the cylinder axis A and threaded through the upper ring 121, the lower ends of the bolts engaging the upper surface of lower ring 122. The hexagonal heads of the bolts are located outside the upper outer cylinder 35 so that they are accessible from above the upper ring 121.

It will be understood that the gaskets 123 and 124 are placed under the desired compression by tightening the bolts 128 so as to force rings 121 and 122 away from each other. These gaskets can be replaced by unscrewing hub 44 from the upper portion of inner cylinder 36 and removing the parts 53, 54, 35 and 125 upwardly from the inner cylinder (FIG. 2). This allows the parts 121–124 of the double expansion joint to be removed from the upper end of the inner cylinder, so that new gaskets can be substituted for the worn ones.

In the operation of the apparatus, the product to be treated is pumped through an inlet duct 5 into the lower end of inner cylinder 36, the pump pressure forcing the product upwardly until it discharges from the upper end of cylinder 36 through outlet duct 6. At the same time, different heat exchange media are circulated through the annular spaces 37 and 38, respectively, to subject the product to substantially different temperatures. For example, the product may be initially heated by the medium in the lower space 37 and then promptly cooled by the medium in the upper space 38. The rotor assembly 70 is driven continuously about the axis A to scrape the inner surface of cylinder 36 free of any product which may adhere thereto, thereby insuring a uniform heating and cooling of the product.

Because of the double expansion joint 120, the annular spaces 37 and 38 for the heat exchange media remain sealed at their ends despite different rates of expansion and contraction of the cylinders 34, 35 and 36. That is, the adjacent end portions of the outer cylinders 34 and 35 are free to slide up and down relative to each other and to the inner cylinder 36 while maintaining sealing contact with the gaskets 124 and 123, respectively.

As illustrated, a temperature sensing device in the form of a thermocouple bulb 130 protrudes through the double expansion joint 120 and into the inner cylinder 36 by way of a hole in its wall. The bulb 130 is placed in its sensing position by inserting it between the rings 121 and 122 after they have been forced apart to their gasket-compressing positions by the bolts 128. In this way, the temperature of the product leaving the lower (heating) portion of cylinder 36 is constantly sensed to enable automatic control of this temperature.

To insure that the product contacts bulb 130 in passing from the lower to the upper portion of cylinder 36, a baffle 132 is provided in this cylinder at a location such that the product must contact the bulb in order to flow around the baffle. As shown in FIG. 1, the baffle is secured to rotor shaft 71, but it could be secured instead to the inner wall of cylinder 36.

The new structure enables a substantial reduction in the cost of a heat exchanger system for a particular use. For example, assume that 6 sq. ft. and 9 sq. ft. are standard areas for heat exchange cylinders and that a particular use of the heat exchanger requires 5 sq. ft. of heating section and 13 sq. ft. of cooling section, which is a common ratio. The practice heretofore would be to provide one heater of 6 sq. ft., one cooler of 6 sq. ft., and one cooler of 9 sq. ft. With the present invention, however, a single unit of 9 sq. ft. would have 5 sq. ft. of heating area and 4 sq. ft. of cooling area, and a second unit of 9 sq. ft. would provide the necessary additional cooling. Thus, the heat exchanger system would now requre only two heat exchange cylinders instead of three, with substantial savings in the cost of the cylinders, the mountings and the drives.

I claim:

1. A swept surface heat exchanger comprising an inner heat exchange cylinder having a vertical axis, the cylinder also having a product inlet at one end and a product outlet at the other end, a rotor assembly mounted for rotation on the axis of said cylinder and including means for scraping the inner wall of the cylinder to free the same of product adhering thereto, upper and lower outer cylinders surrounding the upper and lower portions, respectively, of said inner cylinder and forming therewith upper and lower annular spaces, means sealing the opposite ends of each said annular space and including a double expansion joint located between said upper and lower outer cylinders for accommodating different rates of expansion and contraction of said inner and outer cylinders, and ducts for supplying different heat exchange media to said upper and lower spaces, respectively, said double expansion joint including two gaskets surrounding the inner cylinder and spaced vertically from each other, said gaskets engaging the inner surfaces of said outer cylinders, respectively, at their adjacent end portions, the adjacent ends of the outer cylinders being spaced vertically from each other, an abutment engaging each gasket and against which the gasket is adapted to be compressed to expand the gasket against the inner cylinder and the surrounding outer cylinder, and means for compressing the gaskets against said abutments and extending through the space between the adjacent ends of the outer cylinders.

2. The heat exchanger of claim 1, in which said compressing means include two rings surrounding the inner cylinder and having inner portions engaging the respective gaskets, and means associated with said rings outside the outer cylinders for forcing the rings away from each other.

3. The heat exchanger of clam 1, in which the lower end of the lower outer cylinder is rigidly secured to the lower portion of the inner cylinder, said sealing means also including an expansion joint through which the upper end of the upper outer cylinder is connected to the upper portion of the inner cylinder.

4. The heat exchanger of claim 1, comprising also a temperature sensing device extending through said double expansion joint and through the inner cylinder to the interior thereof, said device having an inner portion located in the path of product passing through the inner cylinder from said inlet to said outlet.

5. The heat exchanger of claim 4, comprising also a baffle located in the inner cylinder in position to deflect said product into contact with the temperature sensing device as the product passes from said inlet to said outlet.

6. The heat exchanger of claim 2, comprising also a temperature sensing device extending between said rings and through the inner cylinder to the interior thereof, said device having an inner portion located in the path of said product passing through the cylinder from said inlet to said outlet.

* * * * *